US005865445A

United States Patent [19]

Svensson et al.

[11] Patent Number: 5,865,445

[45] Date of Patent: Feb. 2, 1999

[54] IN-LINE SKATE BRAKE

[75] Inventors: John E. Svensson, Vashon; Dodd H. Grande, Seattle; Hans D. Grande, Des Monies, all of Wash.; Shin B. Min, Pusan, Rep. of Korea

[73] Assignee: K-2 Corporation, Vashon, Wash.

[21] Appl. No.: 97,719

[22] Filed: Jun. 16, 1998

Related U.S. Application Data

[63] Continuation of Ser. No. 679,076, Jul. 12, 1996, Pat. No. 5,794,950.

[51] Int. Cl.[6] ..... A63C 17/14

[52] U.S. Cl. ..... 280/11.2; 188/5

[58] Field of Search ..... 188/4 R, 5, 32, 188/151 R, 344, 359; 280/11.2, 11.22

[56] References Cited

U.S. PATENT DOCUMENTS

| | | | |
|---|---|---|---|
| 2,638,183 | 5/1953 | Prowinsky . | |
| 5,088,748 | 2/1992 | Koselka et al. . | |
| 5,192,099 | 3/1993 | Riutta . | |
| 5,211,409 | 5/1993 | Mitchell et al. . | |
| 5,226,673 | 7/1993 | Cech . | |
| 5,232,231 | 8/1993 | Carlsmith . | |
| 5,253,882 | 10/1993 | Mitchell . | |
| 5,280,930 | 1/1994 | Smathers et al. . | |
| 5,280,931 | 1/1994 | Horton . | |
| 5,308,093 | 5/1994 | Walin . | |
| 5,320,367 | 6/1994 | Landis | 280/11.2 |
| 5,330,207 | 7/1994 | Mitchell . | |
| 5,335,924 | 8/1994 | Richards, Sr. et al. . | |
| 5,340,131 | 8/1994 | Smathers et al. | 280/11.2 |
| 5,374,070 | 12/1994 | Pellegrini, Jr. et al. . | |
| 5,388,844 | 2/1995 | Pellegrini, Jr. et al. . | |
| 5,465,984 | 11/1995 | Pellegrini, Jr. et al. . | |
| 5,486,012 | 1/1996 | Olivieri . | |
| 5,487,552 | 1/1996 | Daoust . | |
| 5,653,454 | 8/1997 | Chin . | |
| 5,655,783 | 8/1997 | Brosnan . | |
| 5,704,619 | 1/1998 | Mitchell et al. | 280/11.2 |
| 5,772,221 | 6/1998 | Daley | 280/11.2 |

FOREIGN PATENT DOCUMENTS

| | | |
|---|---|---|
| 0 585 764 A1 | 3/1994 | European Pat. Off. . |
| 0 608 740 A2 | 8/1994 | European Pat. Off. . |
| 0 608 740 A3 | 8/1994 | European Pat. Off. . |

*Primary Examiner*—Brian L. Johnson
*Assistant Examiner*—Michael Mar
*Attorney, Agent, or Firm*—Christensen O'Connor Johnson & Kindness PLLC

[57] ABSTRACT

A skate (10) includes a boot (12) and wheels (28), secured to a frame (14), and a brake (16). The boot includes a base (18), a heel counter (20) and a pivotable cuff (22). The brake includes a brake housing (32) connected to the frame by lower arms (34) and to the base of the boot by upper arms (36). A brake pad (38) is secured to the lower end of the brake housing adjacent the wheels. A push rod (40) extends upwardly from a top end of the brake housing along the axis of the brake housing, and bears against a cuff tab (42) secured to the back of the cuff of the boot. Forward pivoting of the cuff of the boot during skating does not activate the brake, while rearward movement of the cuff causes the cuff tab to push down on the push rod (40), resulting in engagement of the brake pad with the ground. Displacement of the brake pad in response to movement of the cuff is amplified by a hydraulic master-slave piston arrangement contained within the brake housing. The master-slave piston arrangement includes a master piston (52) and master diaphragm (56) housed within a master cylinder (54), a slave cylinder (70) positioned below the master cylinder, and a slave diaphragm (74) and slave piston (78).

9 Claims, 8 Drawing Sheets

IN-LINE SKATE BRAKE

CROSS REFERENCE TO RELATED APPLICATION

This application is a continuation of U.S. application Ser. No. 08/679,076 filed Jul. 12, 1996, now U.S. Pat. No. 5,794,950 which claims the benefit of U.S. Provisional Application No. 60/001,164 filed Jul. 14, 1995.

FIELD OF THE INVENTION

The present invention relates to an in-line skate brake and, more particularly, to a cuff-actuated in-line skate brake that includes a slider mechanism and brake pad displacement amplification.

BACKGROUND OF THE INVENTION

As in-line roller skates have increased in popularity, so has the concern over skating safety. In-line skaters commonly skate outdoors, on sidewalks, roads, and bicycle paths. In-line skates are capable of high speeds and may be used in congested areas, streets, or other places where obstacles may be encountered. Numerous braking devices have been developed in an effort to deal with this potentially dangerous situation.

The most common braking device is a simple heel pad. The heel pad is secured to the rear of the skate adjacent the heel and rear wheel of the skate. The pad is constructed of plastic material that creates high friction on the riding surface. To operate the standard heel brake a skater advances the braking skate forward and lifts the toe of the skate while keeping the rear wheel on the riding surface. Once the skate toe is lifted sufficiently, the brake pad contacts the riding surface. The frictional force between the riding surface and the brake pad slows or stops the skater.

Stopping with a heel brake can be difficult due to the maneuvering that the skater must master to use the brake. The muscles that lift the toe tire easily. The skater may have difficulty balancing on a single skate and only the rear wheel of the other skate.

Alternative braking methods are available such as a T-stop or power slide. However, these maneuvers are even more difficult for the beginner to intermediate skater than using the fixed heel pad discussed above.

Advanced braking mechanisms have been devised. Some require that the user run a cable from the brake to his or her hand. A brake caliper similar to a bicycle brake has been created, as has a moving pad (see U.S. Pat. No. 5,211,409). In the latter device the wheels of the braking skate all remain on the ground while the pad is pivotally moved to the ground by squeezing a cable connected brake handle. The brake is on a carriage pivotally attached to the skate frame. Other brakes with hand held actuators have also been developed. However, they have not enjoyed widespread use due to the inconvenience associated with the cables and having to hold something in hand. Also, if the brakes are actuated without proper body positioning they could cause the skater to lose his or her balance by throwing the skater forward.

Cuff-actuated brakes have also been developed. These brakes harness the rearward pivotal movement of the cuff as one skate (the braking skate) is moved in front of the other skate with all wheels remaining on the skating surface. Two general types of these skates have emerged: those with ground engaging members and those that apply a resistance element to the skate wheels themselves.

The cuff-actuated brakes that apply a braking pad to the ground have enjoyed some success in the marketplace.

These braking systems include a brake carriage that is pivotally attached to the skate frame for movement toward and away from the riding surface. The carriage pivot axis is typically the rear axle axis of the skate or an axis parallel thereto. A brake pad is attached to bottom of the carriage for frictionally engaging the riding surface. A link is provided between the top of the carriage and cuff. Thus, when the cuff is rotated rearwardly, by pushing the braking skate ahead of the skater, the carriage is pivoted downwardly until the pad contacts the riding surface.

Despite the advances of these cuff-actuated brakes they still have drawbacks. For example, rearward cuff movement can be somewhat limited such that the brake pad must be positioned close to the riding surface or the pad will not contact the riding surface without lifting the toe. With the pad close to the riding surface it can inadvertently contact the ground or other obstacles and upset the balance of the skater. Furthermore, the link between the carriage and cuff pulls the brake up when the skater leans forward in the cuff. Having to pull the brake carriage up during every skating step may create unnecessary work for the skater, especially if additional friction is encountered in the pivotal connection of the carriage to the frame when it is pulled up.

Therefore, owing to the drawbacks of the above-described skate brakes, the present invention was developed. The various embodiments of the present invention effectively eliminate forward motion friction due to brake pad connection, problems inherent in low positioned brakes, and difficulty of use.

SUMMARY OF THE INVENTION

The present invention provides a brake for an in-line skate. The skate includes a base, a cuff movably secured to the base, and wheels secured to the base for rolling on a riding surface. The brake includes a tab secured to the cuff and an elongate member movably secured to the base. The elongate member has a lower end and an upper end. The upper end is positioned adjacent the cuff tab so as to contact the tab when the cuff is moved rearwardly with respect to the base. A brake element is secured to the lower end of the elongate member so as to be positioned in proximity to at least one of the wheels.

In a preferred embodiment, the brake further includes a slide housing attached to the base, with the elongate member being slidably secured to the base with the housing. The elongate member includes an upper portion and a lower portion, with a fluid such as hydraulic brake fluid being disposed between the upper and lower portions. The slide housing includes a master cylinder within an upper portion of the housing and a slave cylinder within a lower portion of the housing. The upper portion of the elongate member extends within the master cylinder, while the lower portion of the elongate member extends within the slave cylinder. The fluid is disposed at least partially within the master cylinder and within the slave cylinder. In a preferred embodiment of the present invention, the diameter of the master cylinder is greater than the diameter of the slave cylinder so as to amplify movement of the brake element, which is secured to the lower end of the lower portion of the elongate member, relative to movement of the upper portion of the elongate member in response to cuff movement.

In a further embodiment of the present invention, the brake includes a slide housing secured to the base and a slide member slidably secured within the slide housing to slide toward and away from the riding surface. The slide member has an upper end coupled to the cuff such that rearward movement of the cuff relative to the base slides the slide member toward the riding surface, and a lower end to which a brake element is secured in proximity to the riding surface. A tab secured to the skate cuff contacts the top of the slide member, which is biased toward the tab by a biasing member disposed within the housing.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENTS

Figure 7:
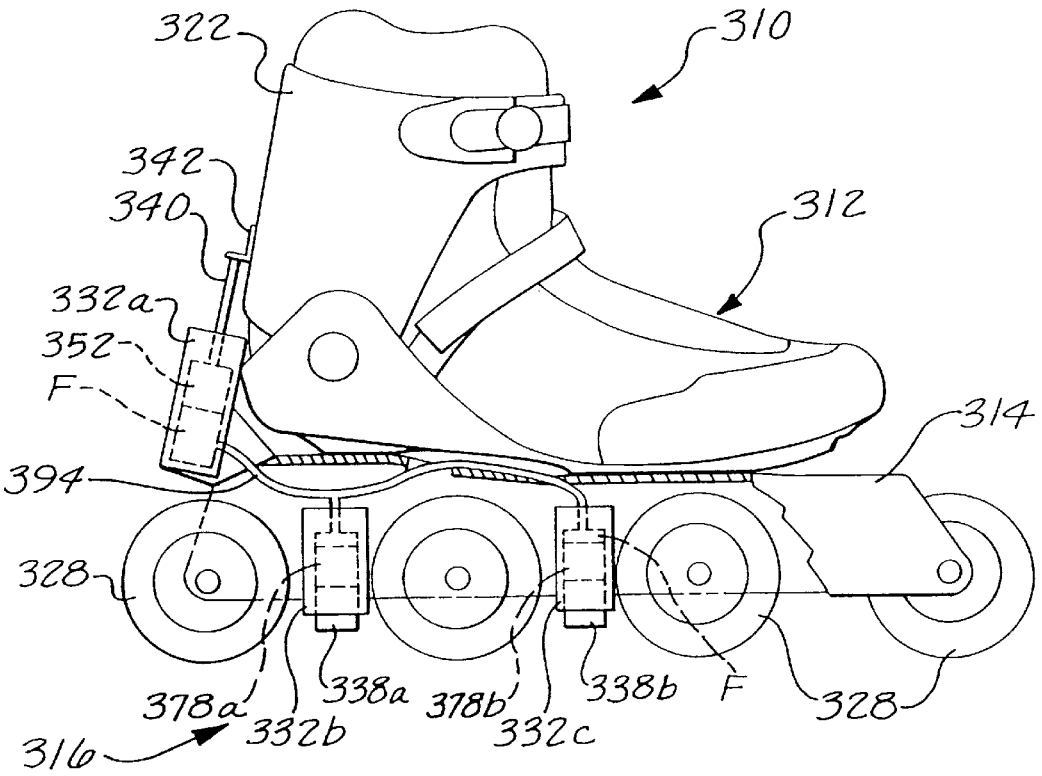
FIG. 7 is a side elevational view of an alternate embodiment of the present invention with brake pads being actuated between wheels.
Figure 8:
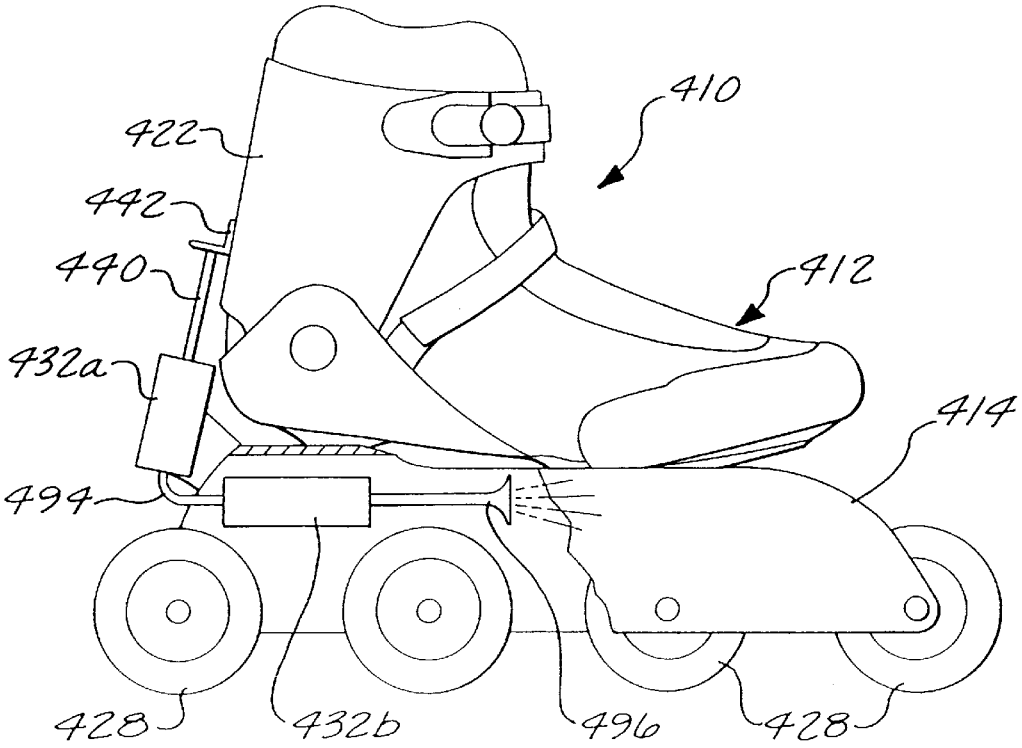
FIG. 8 is a side elevational view of an alternate embodiment of the present invention showing a horn.

Referring first to FIGS. 1–4, the preferred embodiment of the brake of the present invention will be described including all major parts and their interconnections. After a detailed discussion of the preferred embodiment of the brake, minor changes that could be made in the construction of the preferred embodiment will be discussed with reference to FIGS. 5 and 6. FIGS. 7 and 8 will then be discussed to present alternative skate cuff-actuated, fluid-driven devices. The discussion will then turn to an alternative slider brake, illustrated in FIG. 9, that does not include hydraulics. Finally, brake lights will be discussed in connection with FIG. 10.

The preferred embodiment of the present invention is for use with a skate 10 that includes a boot 12 and a frame 14. The invention comprises a brake 16 for attachment to the back of boot 12 and frame 14. Brake 16 could be used or adapted for use with any skate that includes an upper portion (e.g., cuff) that moves rearwardly with respect to a lower portion (e.g., frame) when a skater moves his or her foot forward.

Preferably, boot 12 includes a base 18, a heel counter 20, and a cuff 22. Base 18 extends along the bottom of boot 12 and is substantially rigid. Heel counter 20 extends upwardly from base 18 around the heel area of boot 12 and is also substantially rigid. Cuff 22 extends upwardly from heel counter 20 and includes a strap 24 to secure cuff 22 and an upper portion of boot 12 about the lower portion of the skater's leg. Cuff fasteners 26 secure cuff 22 to heel counter 20 such that cuff 22 may be pivoted forward or rearward with respect to heel counter 20 and base 18.

Frame 14 may be any standard in-line skate frame for carrying wheels 28. Axle bolts 30 extend through frame 14 to secure wheels 28, preferably in an aligned arrangement. Frame 14 may be attached to base 18 by rivets, bolts, integral molding, or other means.

In the preferred embodiment of the invention, brake 16 is attached to base 18 and to frame 14. Brake 16 includes brake housing 32, lower arms 34, upper arms 36, brake pad 38, push rod 40, and cuff tab 42. Brake housing 32 is generally cylindrical in shape and extends nearly vertically with a slight forward tilt behind rear wheel 28. Lower arms 34 extend forwardly from the bottom of brake housing 32 adjacent the sides of rear wheel 28. Lower arms 34 are preferably attached to frame 14 with axle bolt 30 of rear wheel 28. Upper arms 36 extend forwardly from the mid- to upper portion of brake housing 32. The forward ends of upper arms 36 are attached to the bottom of base 18 below heel counter 20. Brake pad 38 is secured between the rearward ends of lower arms 34 at the base of brake housing 32. Brake pad 38 preferably has the general shape of standard brake pads. The bottom surface of brake pad 38 is generally parallel to the riding surface. Push rod 40 extends upwardly from within the top end of brake housing 32 along the axis of brake housing 32 to a position adjacent the lower rearward portion of cuff 22.

Cuff tab 42 is positioned just above the top of push rod 40. Cuff tab 42 is generally L-shaped with the upright portion of cuff tab 42 being riveted to the back of cuff 22. The lower end of cuff tab 42 provides a paddle for pushing downwardly on push rod 40 when cuff 22 is pivoted rearwardly about cuff fasteners 26. When cuff 22 is pivoted forwardly and brake pad 38 is already in an upward, retracted position, push rod 40 does not follow cuff tab 42 since it is not fixedly connected thereto. Thus, forward movement of cuff 22 during skating is not hindered by having to pull push rod 40, brake housing 32, or brake pad 38 as the skater moves his or her legs during skating. However, if the skater desires to engage brake pad 38 with the ground, he or she simply needs to move skate 10 forward such that cuff 22 is pivoted rearwardly. Cuff tab 42 pushes downwardly on push rod 40 to activate brake pad 38 to come in contact with the riding surface as explained in more detail below.

Figure 1:
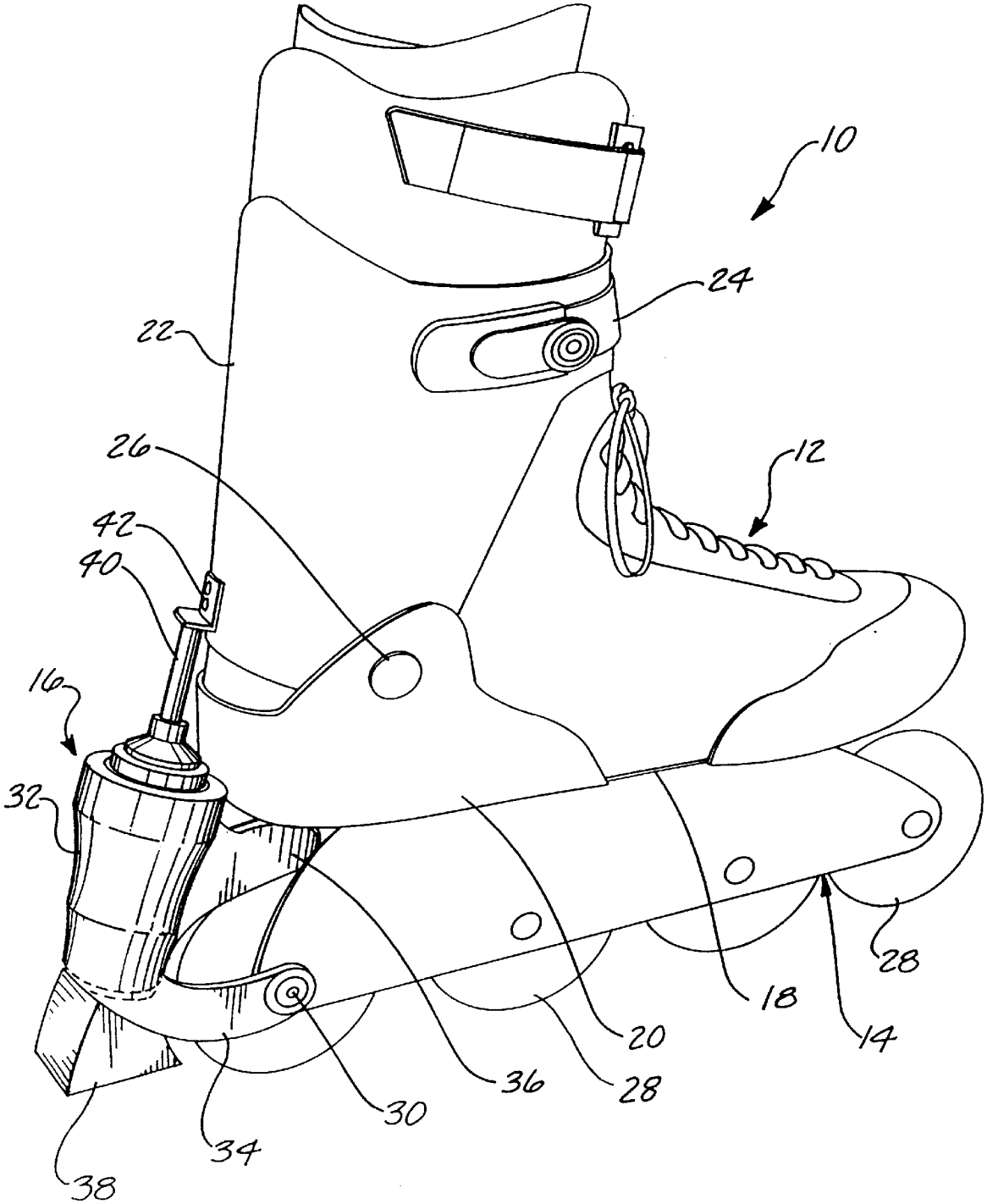
FIG. 1 is a perspective view of the hydraulic braking system of the present invention shown mounted to the rear of a skate.
Figure 2:
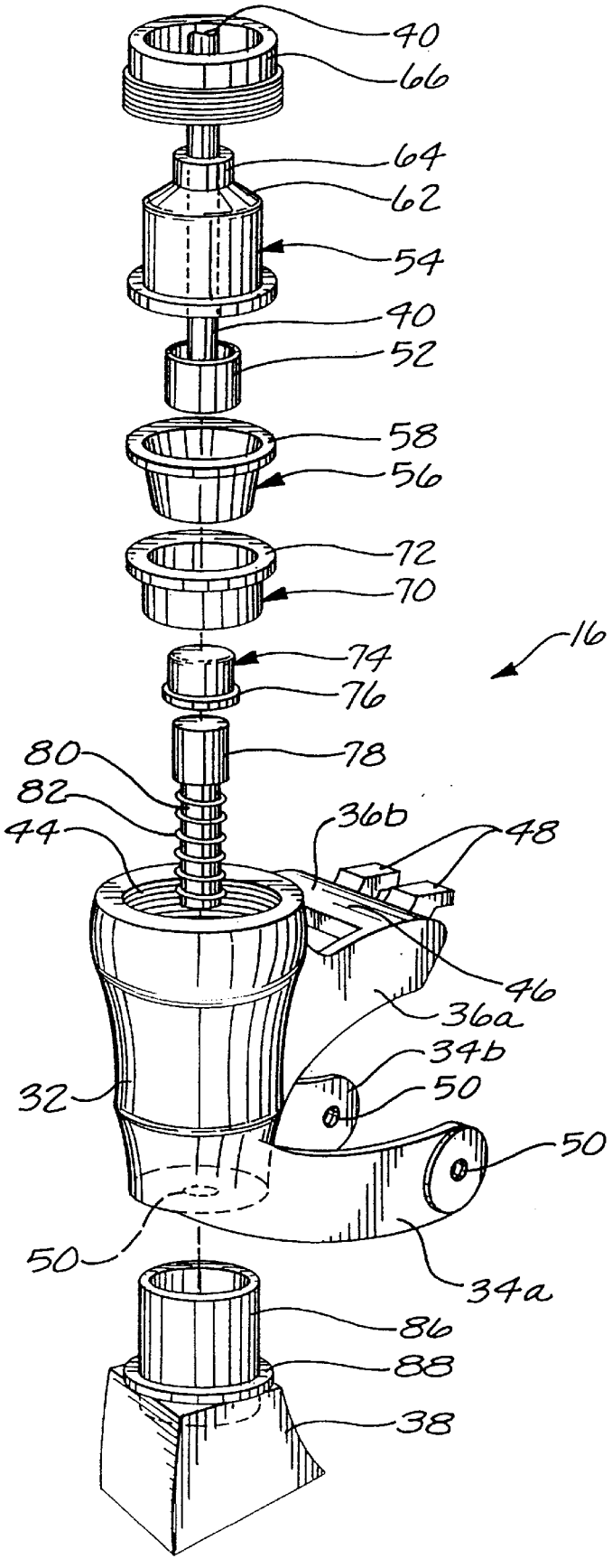
FIG. 2 is an exploded perspective view of the brake.
Figure 3:
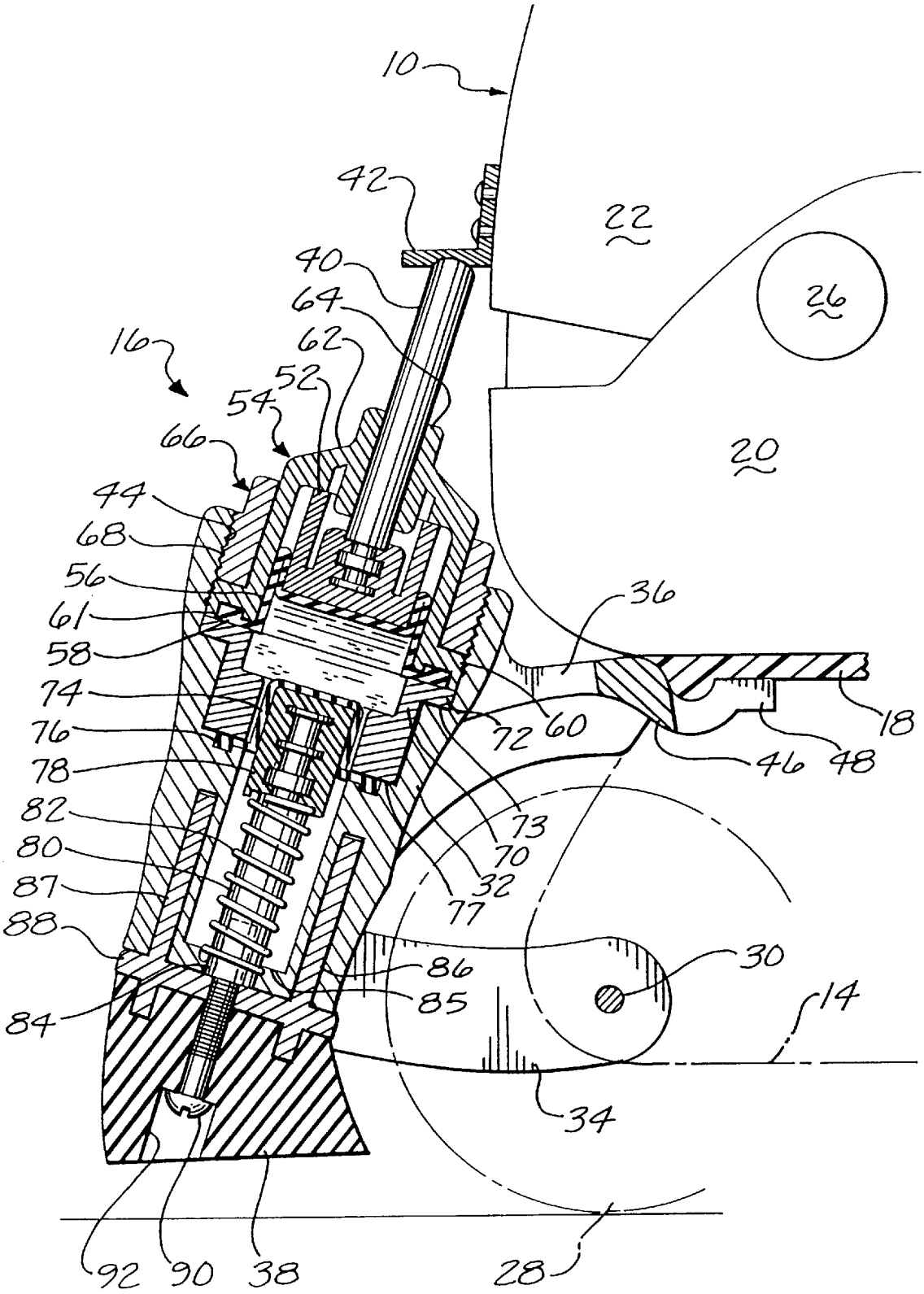
FIG. 3 is a cross-sectional elevational view of the invention.

FIG. 2 illustrates the construction of brake 16 in further detail. Brake housing 32 is preferably integrally connected to lower arms 34 (34*a* and 34*b*) and upper arms 36 (36*a* and 36*b*). As seen in FIG. 2, this integral unit includes housing threads 44 disposed within the inside upper end of brake housing 32. A mount bridge 46 extends between right upper arm 36*a* and left upper arm 36*b*. Mounting hooks 48 project forwardly from mount bridge 46 to engage a ridge or aperture in the bottom of base 18 beneath heel counter 20, as illustrated in FIG. 3. Lower arms 34 also include axle bolt apertures 50 for attachment to frame 14 with axle bolts 30 as illustrated in FIG. 1.

The internal construction of brake 16 will now be described with reference to both FIGS. 2 and 3. The basic construction of brake 16 is for use with hydraulic fluid F, although other fluids could be used, in a master-slave piston arrangement to amplify the displacement of brake pad 38 in response to movement of cuff 22. Thus, a dual piston or plunger arrangement is provided, with fluid F between the two pistons.

Push rod 40 contacts cuff tab 42 at its upper end. A master piston 52 is secured to the lower end of push rod 40 within brake housing 32. Master piston 52 is slidably held within master cylinder 54, also secured within the top of brake housing 32. A master diaphragm 56 that includes a master diaphragm flange 58 is coupled to the bottom of master cylinder 54 in order to seal fluid F to prevent its escaping from brake housing 32. Master diaphragm 56 is preferably a rolling diaphragm to prevent the occurrence of leaks at any seal cylinder interface. Master diaphragm 56 simply rolls and collapses within itself as master piston 52 moves downwardly. Space is provided between the sides of master piston 52 and master cylinder 54 to accommodate the collapsed sides of master diaphragm 56. Master cylinder 54 includes a master cylinder flange 60 projecting outwardly around its lower end. A flange recess 61 is provided within the bottom side of master cylinder flange 60 in order to house master diaphragm flange 58. The top of master cylinder 54 is provided with a dome 62 that extends from the sidewalls of master cylinder 54 toward push rod 40. A push rod sleeve 64 is secured to the central portion of dome 62 to encircle and provide sliding engagement between master cylinder 54 and push rod 40. Push rod sleeve 64 also helps to provide proper alignment of push rod 40 within master cylinder 54.

A retaining ring 66 is provided with an inside diameter just larger than the outside diameter of master cylinder 54 above master cylinder flange 60. The outside lower surface of retaining ring 66 includes threads that matingly engage housing threads 44 within the upper end of brake housing 32. After master cylinder 54 and the other internal components of brake 16 are placed within brake housing 32, retaining ring 66 secures the assembly in place. The bottom of retaining ring 66 bears against the top of master cylinder flange 60.

A slave cylinder 70 is positioned below master cylinder 54. Slave cylinder 70 includes a slave cylinder flange 72 around the top edge thereof. Slave cylinder flange 72 projects outwardly in a manner similar to master cylinder flange 60. The outside diameter of slave cylinder flange 72 and the inside diameter of slave cylinder flange 72 are generally the same as those of master cylinder flange 60. Both flanges fit within the widest opening within the top of brake housing 32 just below housing threads 44. First shoulder 73 is provided within brake housing 32 below housing threads 44. Slave cylinder flange 72 rests on first shoulder 73 while the remainder of slave cylinder projects downwardly therefrom into a smaller internal diameter section of brake housing 32. The bottom of slave cylinder 70 abuts against second shoulder 77 that projects further inwardly within brake housing 32.

A slave diaphragm 74 is positioned within a reduced diameter section of slave cylinder 70. Slave diaphragm 74 includes a slave diaphragm flange 76 projecting outwardly at the bottom thereof. Slave diaphragm flange 76 includes a rim that fits within a recess circumscribing second shoulder 77. Slave cylinder 70 presses slave diaphragm flange 76 against second shoulder 77 as pressure is applied from above to slave cylinder 70 from master diaphragm flange 58, master cylinder flange 60, and retaining ring 66. Thus, fluid F only contacts master diaphragm 56, slave cylinder 70, and slave diaphragm 74. In this manner, and with the sealing arrangement described, there is little risk of failure of seals and thus, of leakage of fluid F.

A slave piston 78 is positioned beneath slave diaphragm 74. Due to the presence of fluid F, slave diaphragm 74 conforms to the upper shape of slave piston 78 as does master diaphragm 56 to master piston 52. Slave diaphragm 74 is also preferably a rolling diaphragm. Slave piston 78 is in axial alignment with master piston 52 and push rod 40. However, the surface area of the top of slave piston 78 is approximately half of the surface area of the bottom of master piston 52, such that a 2-to-1 ratio exists. Thus, if master cylinder 52 is moved downwardly a distance of one millimeter, slave piston 78 is moved a distance of two millimeters by fluid F. In this manner, fluid F amplifies the displacement of slave piston 78.

A slave rod 80 is attached to and projects downwardly from slave piston 78 within brake housing 32. Slave rod 80 is axially aligned within brake housing 32 and with pistons 52 and 78. Alternatively, slave piston 78 and slave rod 80 do not need to be axially aligned with master piston 52 and piston rod 40. Fluid F provides the link between the two pistons and may run in any direction or even through a fluid line, as discussed below in connection with FIGS. 7 and 8. Slave rod 80 extends to the bottom of and through brake housing 32 through a slave rod aperture 84 provided in the bottom of brake housing 32.

A third shoulder 85 is provided within the bottom of brake housing 32 between the inner wall of brake housing 32 and slave rod aperture 84. A spring 82 is disposed on slave rod 80 between slave piston 78 and third shoulder 85. Spring 82 is a helical compression spring. The diameter of slave piston 78 is slightly larger than that of slave rod 80 such that the top of spring 82 seats against the bottom of slave piston 78 while the bottom of spring 82 seats against third shoulder 85. Spring 82 is slightly precompressed such that it holds slave piston 78 is an upward-most position until acted upon with sufficient force by fluid F.

Brake pad 38 is secured to the bottom end of slave rod 80. A cylindrical mount sleeve 86 is provided to be secured within a sleeve recess 87 extending within the lower end of brake housing 32. Sleeve recess 87 extends upwardly from the bottom of brake housing 32 completely around and separated from slave rod 80. Pad mount sleeve 86 includes a mount sleeve base 88 part way up from the bottom of pad mount sleeve 86. Mount sleeve base 88 abuts against the bottom of brake housing 32 when slave piston 78 is an upward-most position. Thus, in cross-section, pad mount sleeve 86 looks somewhat like an H-shape with the upper ends of the sleeve being slidably engaged within brake housing 32 and the lower ends projecting into brake pad 38 with the base 88 between brake pad 38 and brake housing 32. The upper end of pad mount sleeve 86 freely slides within brake housing 32, but counteracts any forces generally perpendicular to the axis of slave rod 80. A pad-retaining bolt 90 extends through brake pad 38, mount sleeve base 88 and into a threaded lower end of slave rod 80. A bolt recess 92 is provided in the bottom of brake pad 38 to avoid the head of pad-retaining bolt 90 from contact with the ground surface during braking. Thus, pad-retaining bolt 90 securely holds brake pad 38 onto pad mount sleeve 86 and slave rod 80 for movement with slave rod 80 toward and away from the riding surface.

Figure 4:
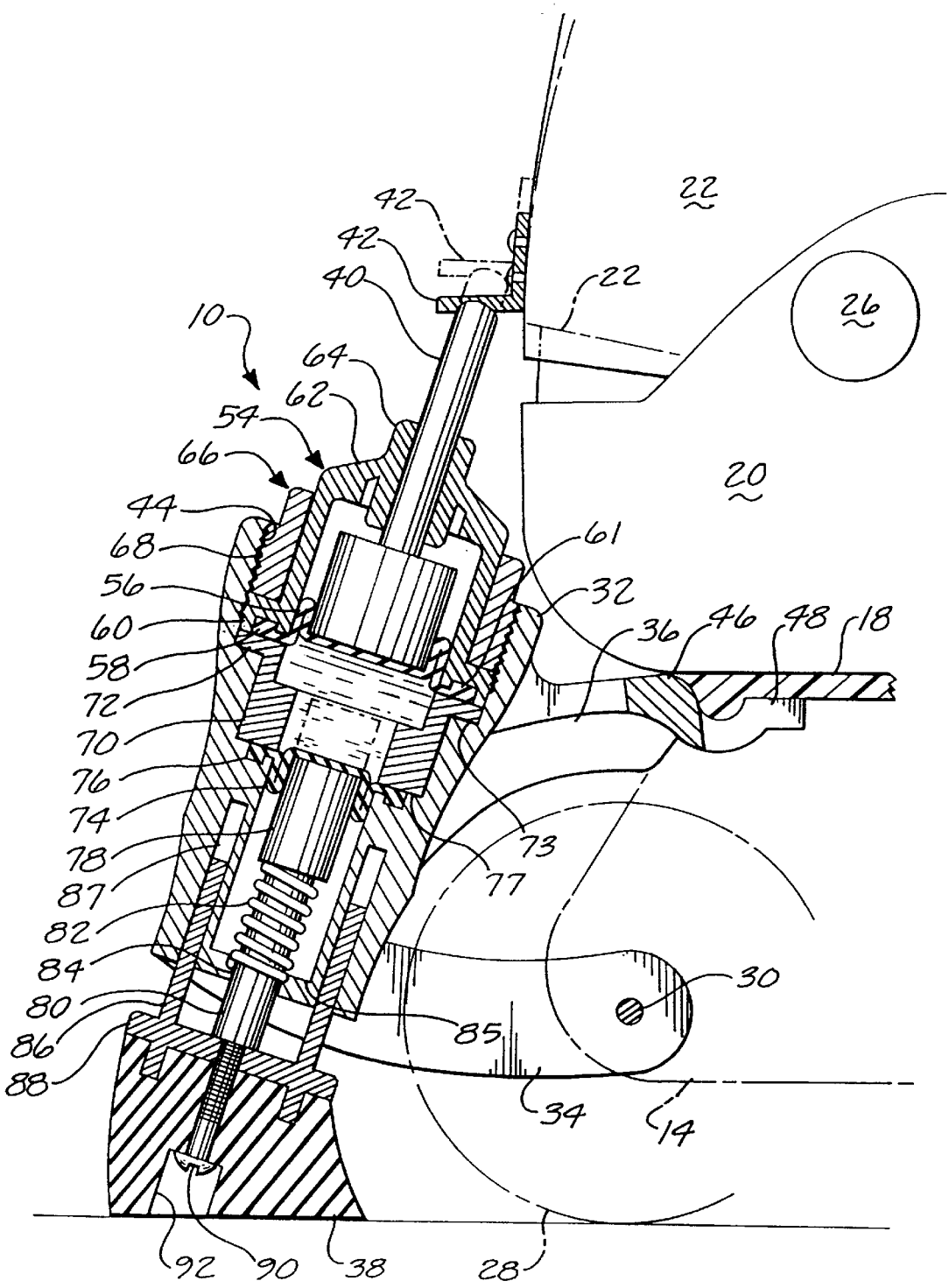
FIG. 4 is a cross-sectional elevational view of the brake of the present invention showing activation of the brake.

FIG. 4 illustrates the actuation of brake 16 upon rearward pivotal movement of cuff 22. As the skater moves skate 10 forward, cuff 22 pivots rearwardly about cuff fasteners 26. When this happens the relative position of cuff tab 42 to base 18 and frame 14 moves down. Downward movement of cuff tab 42 pushes push rod 40 such that master piston 52 moves down within master cylinder 54. This movement and the seal provided by master diaphragm 56 moves fluid F further into the reduced section of slave cylinder 70. Since the reduced section area is approximately half that of the area of master cylinder 54, as the fluid presses against slave diaphragm 74, slave piston 78 moves down twice the distance that master piston 52 moves. Slave rod 80 thereby pushes pad mount sleeve 86 down such that brake pad 38 contacts the ground for braking action. As pad mount sleeve 86 moves downwardly, its upper ends remain partially within sleeve recess 87 to counteract the horizontal frictional forces applied to brake pad 38 by the riding surface as brake pad 38 contacts the riding surface during forward motion of skate 10.

Note that other area ratios could be used between master cylinder 54 and slave cylinder 70 to vary the amplification of motion upon rearward pivotal movement of cuff 22. Amplification of motion is desirable so as to maintain brake pad 38 well above the skating surface until braking is desired. Thus, inadvertent braking action will be avoided while brake pad 38 can be easily and effectively moved down to the riding surface when desired. In the event that anything should fail within brake 16, brake pad 38 can still be used as a standard brake by lifting the toe of the skate to apply brake pad 38 to the riding surface. Brake pad 38 will not simply further retract upwardly relative to frame 14 and wheel 28 since it will abut against the lower portion of brake housing 32.

An adjustment mechanism can also be provided to lengthen push rod 40 or to reposition cuff tab 42 as pad 38 is worn away under normal use. For example, push rod 40 could be divided into two sections with a screw connection between the sections such that the end of push rod 40 can be screwed outwardly to effectively lengthen push rod 40. Alternatively, cuff tab 42 may be adjustably mounted to the back of cuff 22 for upward and downward settings.

Figure 6:
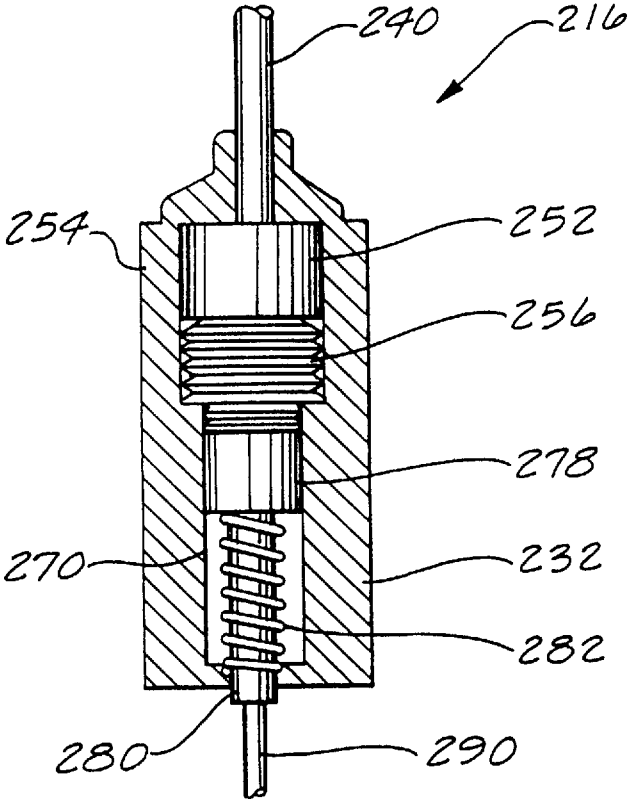
FIG. 6 is a cross-sectional elevational view of an alternate embodiment of the present invention showing a bellows ladder.
Figure 5:
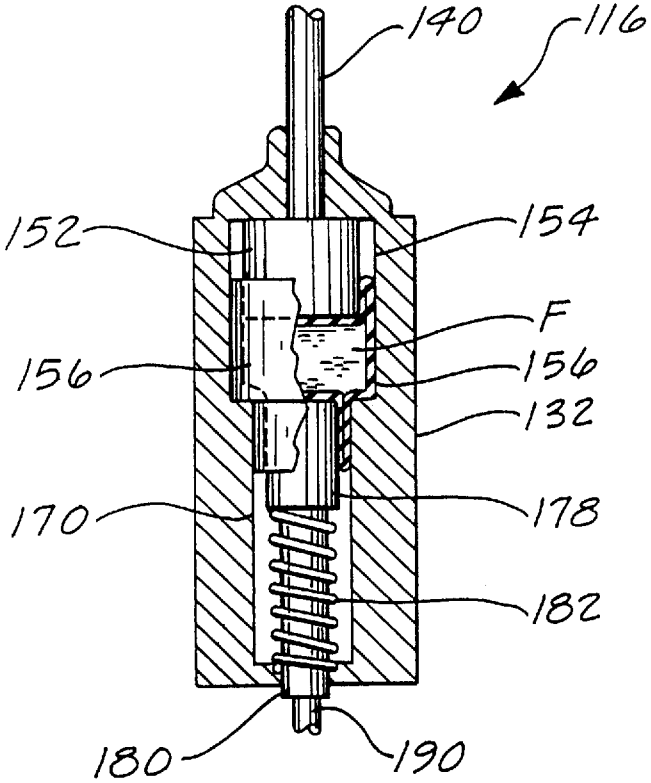
FIG. 5 is a cross-sectional elevational view of an alternate embodiment of the invention showing a fluid ladder.

FIGS. 5 and 6 illustrate alternative methods of containing fluid F. As illustrated in FIG. 5, fluid F is contained within a sealed bladder 156 that is placed within brake housing 132. Sealed bladder 156 may still act as a rolling diaphragm with respect to a master piston 152 and a slave piston 178. However, with bladder 156 no sealing is required between any individual cylinders such as the slave cylinder 170 and a master cylinder 154. A push rod 140, a spring 182, a slave rod 180, and a bolt 190 would perform essentially the same functions as the corresponding elements described above.

FIG. 6 illustrates another alternative enclosure for fluid F. In this embodiment, a bellows bladder 256 is provided between a master piston 252 and a slave piston 278 within a master cylinder 254 and a slave cylinder 270, respectively. Bellows bladder 256 contains an upper section that has a larger diameter than the lower section so as to achieve the motion amplification characteristics described above. The remaining elements illustrated correspond to those described above. A push rod 240 is provided for attachment to the top of master cylinder 254. A spring 282 biases slave piston 278 in an upward position. Spring 282 is disposed on a slave rod 280 that pushes the brake pad down to the riding surface, the pad being attached by bolt 290.

FIG. 7 illustrates an alternate embodiment of the brake of the present invention wherein the master cylinder and master piston are separated from the slave cylinder and the slave piston by a fluid line 394. However, the basic functioning of the brake is the same. A skate 310 is provided that includes a boot 312 and a frame 314 holding wheels 328. Boot 312 includes a cuff 322 pivotally attached thereto with a cuff tab 342 on the back thereof. Cuff tab 342 pushes downwardly on a push rod 340 when cuff 322 is pivoted rearwardly. Push rod 340 enters an upper brake housing 332*a* wherein master piston slides. As push rod 340 moves downwardly, master piston 352 moves fluid F into fluid line 394. Fluid line 394 is connected to two lower brake housings 332*b* and 332*c* positioned between the wheels 328. Slave pistons 378*a* and 378*b* are contained within each of lower brake housings 332*b* and 332*c*, respectively. When compressed fluid F forces slave pistons 378*a* and 378*b* downwardly, brake pads 338*a* and 338*b* are forced into contact with the riding surface between the wheels.

Alternatively, a brake pad with its associated slave cylinder and piston could be located between each of the wheels of skate 310. Brakes 316 could alternatively be applied to exert a force on the wheels themselves instead of on the riding surface.

Alternative mechanisms could also be activated by using the basic fluid system described in the several embodiments above. For example, as illustrated in FIG. 8, a skate 410 could be provided that included a boot 412 and a frame 414 with wheels 428 and cuff 422. A cuff tab 442 is provided on the back of cuff 422 to push a push rod 440 within an upper housing 432*a*. The internal workings within upper housing 432*a* would be similar to those discussed above with a fluid such as a hydraulic fluid or a gas. A fluid line 494 extends from upper housing 432*a* to a lower housing 432*b*. In this embodiment, a horn 496 is attached to lower housing 432*b* to emit an audible signal when cuff 422 is pivoted rearwardly. This device is illustrated just as an example of the actuation mechanisms that could be used with such a fluid actuation device.

Figure 9:
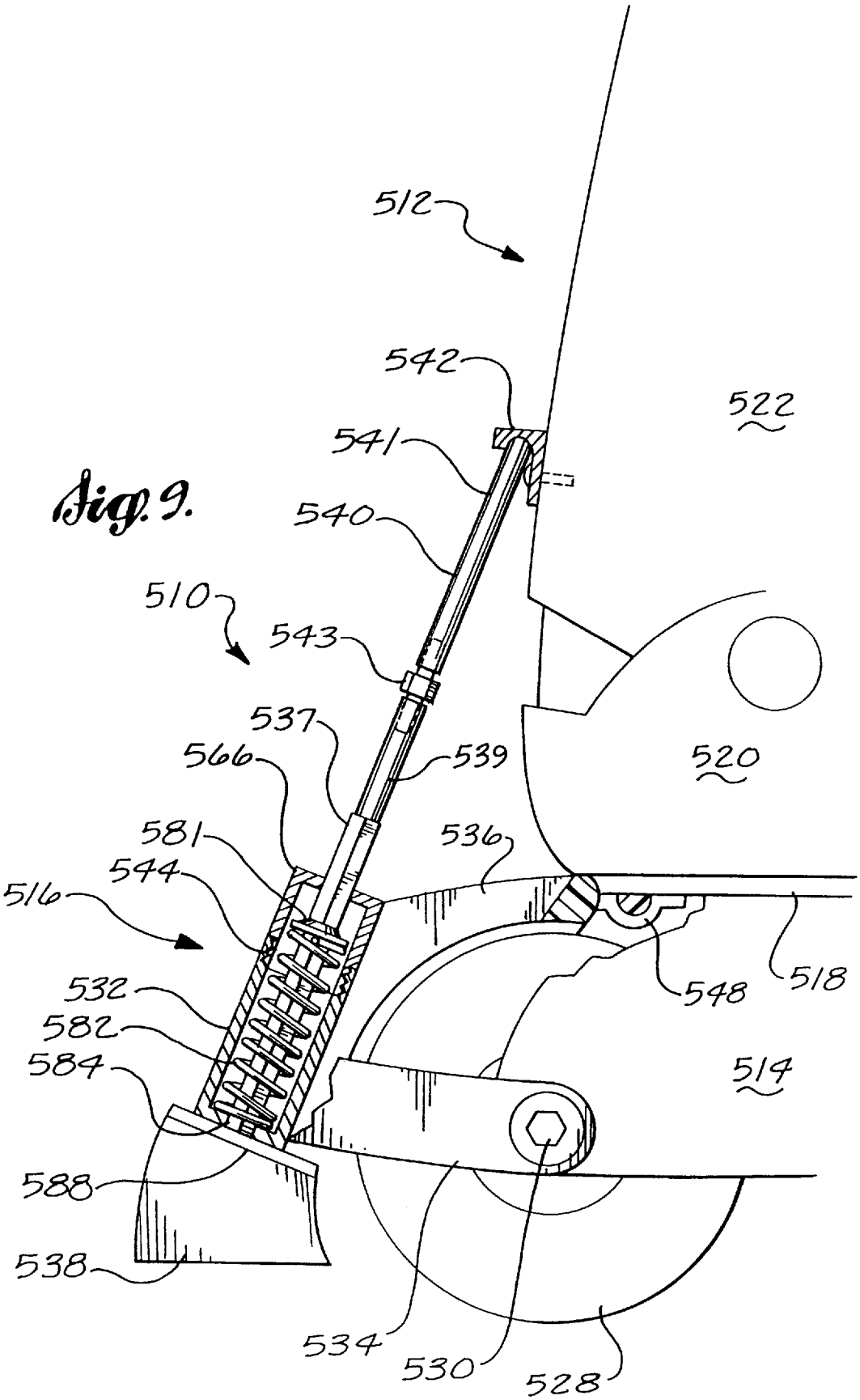
FIG. 9 is a side elevational view of an alternate embodiment of the present invention employing a slider mechanism.

A simplified embodiment of the present invention is illustrated in FIG. 9. In this embodiment, hydraulic fluids are not used, but the advantages of a cuff tab connection to a push rod as well as a slider mechanism to advance a brake pad to the ground are still provided. In this embodiment a boot 512 is provided that includes a base 518 with a heel counter 520 attached thereto and a pivotally-attached cuff 522. A frame 514 is secured to the bottom of base 518. Wheels 528 are secured to frame 514 with axle bolts 530. Brake 516 is secured to the rear of boot 512 and frame 514. Brake 516 includes a brake housing 532 that is generally cylindrical and includes internal threads on its upper end. Brake housing 532 is secured to frame 514 with lower arms 534 similar to arms 34 described above. Brake housing 532 is also secured to base 518 with upper arms 536 and mounting hooks 548 comparable to upper arms 36 and mounting hooks 48 discussed above.

A housing cap 566 that is also cylindrical in shape and includes an upper opening is provided for being secured to brake housing 532.

A cuff tab 542 is secured to the back of cuff 522. Cuff tab 542 is similar to cuff tab 42 discussed above except that it is inverted. A push rod 540 extends from cuff tab 542 into housing cap 566 and through brake housing 532. Push rod 540 is made up of multiple sections, an upper section 541 and a lower section 539. Between upper section 541 and lower section 539, an adjustment screw 543 is provided for changing the length of push rod 540 to accommodate for wear on brake pad 538. Adjustment screw 543 basically comprises a knob with two screw ends, one projecting into upper section 541 and the other projecting into lower section 539.

Upper section 541 is preferably circular in cross-section, while lower section 539 includes a square section 537 at its lower end. Square section 537 extends through housing cap 566 and through the bottom of brake housing 532 to prevent rotation of lower section 539 relative to brake housing 532 and skate 510. The lower end of square section 537 is attached to a pad mounting base 588 and a brake pad 538. When brake pad 538 contacts the ground it may contact at one side or the other with more force and thus, introduce a force tending to twist brake pad 538 and push rod 540 relative to brake housing 532 and skate 510. This force is counteracted by the engagement of square section 537 of push rod 540 through housing cap 566 and rod aperture 584 within the lower end of brake housing 532. Any other non-circular cross-sectional shape could alternatively be employed in place of square section 537.

A spring 582 is disposed around the lower end of square section 534 within brake housing 532 and housing cap 566. Spring 582 is a helical compression spring. A spring retention shoulder 581 is secured to square section 537 within brake housing 532 and housing cap 566 for the top end of spring 582 to seat against. The lower end of spring 582 seats against the bottom of brake housing 532 around rod aperture 584. Spring 582 biases brake pad 538 away from the riding surface. Thus, the brake will not contact the surface inadvertently when cuff 522 is not rotated rearwardly.

As with the previous embodiments discussed above, since cuff tab 542 is not affixed to push rod 540, cuff 522 is free to move without being restrained by brake 516. Cuff tab 542 is in an inverted configuration to allow the lower portion thereof to guide upper section 541 of push rod 540 into proper engagement with the upper section of cuff tab 542.

Figure 10:
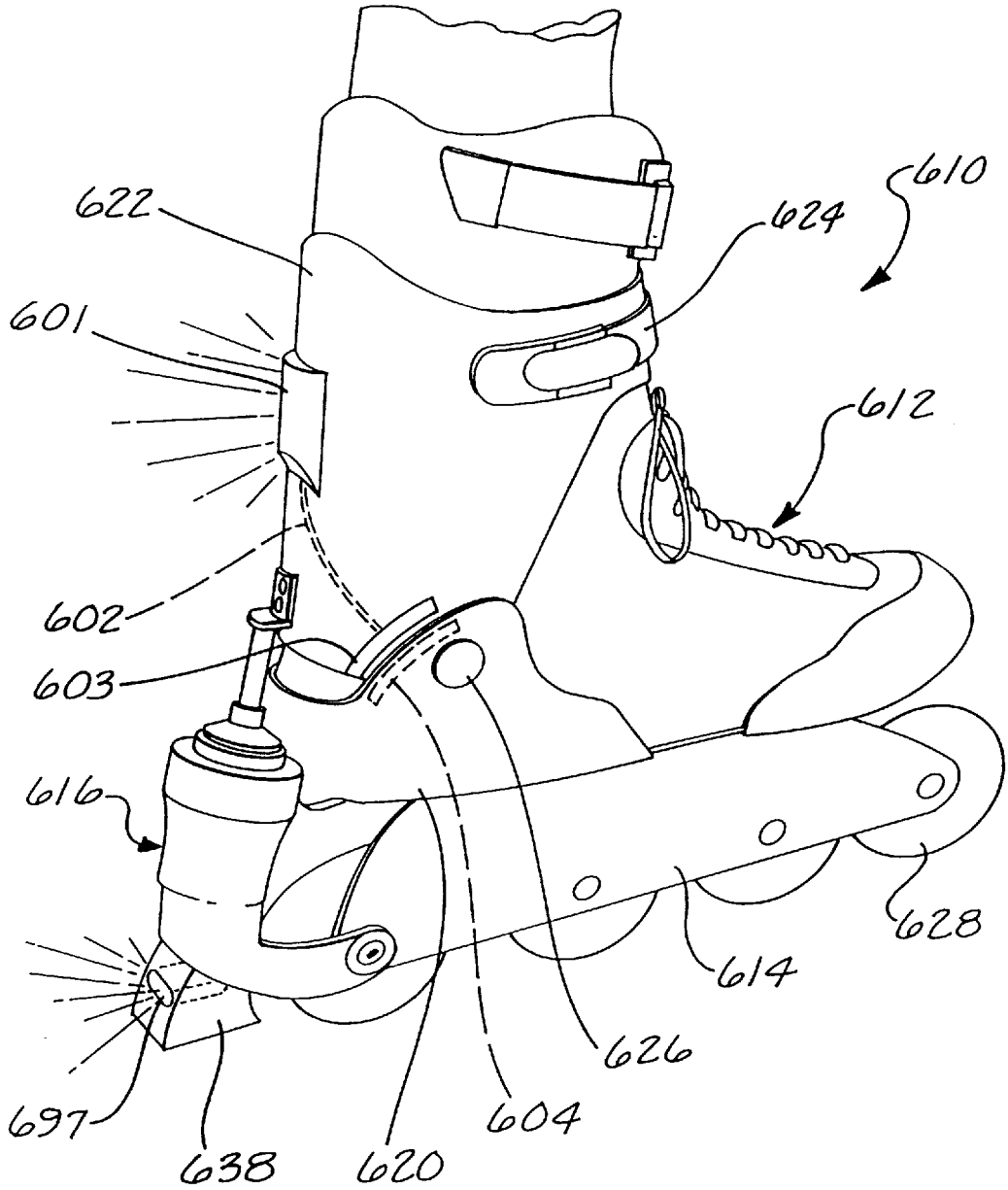
FIG. 10 is a perspective view of various brake lights employed with the present invention.

A brake lighting system may also be provided as part of the preferred embodiment of the invention, as illustrated in FIG. 10. A skate 610 is provided that includes a boot 612 and a frame 614. Frame 614 holds wheels 628. Boot 612 includes a heel counter 620 with a cuff 622 pivotally attached thereto. Cuff 622 includes a strap 624 for securing boot 612 to the lower leg of the user. Cuff 622 pivots about cuff fastener 626 pivotally coupling cuff 622 to heel counter 620 so as to pivot in a fore and aft direction. A brake 616 similar to brake 16 discussed above may be secured to the rear of skate frame 614 and boot 612. Brake 616 includes brake pad 638 secured at the bottom thereof. A pad light 697 is disposed within brake pad 638. Pad light 697 is a standard light that is actuated by compression on the sides of the light casing. Such lights are known in the art and are used, for example, within the heels of athletic shoes. The placement of pad light 697 within the middle of brake pad 638 allows pad light 697 to be turned on by simply forcing brake pad 638 into contact with the riding surface such that brake pad 638 is somewhat compressed. This compressive force is transferred to pad light 697 such that the light is activated. A soft section of brake pad 638 may be provided in order to more easily actuate pad light 697 by allowing compressive forces to be transferred to pad light 697.

An alternate lighting system may also be employed with or without pad light 697 and brake 616. In this embodiment, a cuff light 601 is secured to the rear of cuff 622. Cuff light 601 may be provided with its own battery power or may be powered by a battery contained elsewhere on frame 614 or boot 612, or even on the skater. Cuff light 601 is preferably adhesively attached to the back of cuff 622. Cuff light 601 is activated by rearward pivotal motion of cuff 622 relative to heel counter 620. A cuff contact plate 603 is provided on cuff 622 and a heel counter contact plate 604 is provided on heel counter 620. Cuff contact plate 603 is adjacent heel counter contact plate 604, with heel counter contact plate 604 being disposed on the inside surface of heel counter 620. When cuff 622 is pivoted rearwardly, cuff contact plate 603 comes into contact with heel counter contact plate 604 to activate cuff light 601 with wire 602 extending between cuff contact plate 603 and cuff light 601. Heel counter contact plate 604 may either close an open connection created on cuff contact plate 603 or may close a connection to a separate power source apart from cuff light 601 such as an external battery or small generator attached to one of the wheels.

Providing lights such as cuff light 601 or pad light 697 provides an extra margin of safety to a skater and those around the skater, especially when skating in traffic or congested areas. The light would be actuated only when braking is actuated or when the user puts the skate forward such that the cuff is pivoted rearwardly, typically the action needed to actuate brake 616.

While the preferred embodiments of the invention have been illustrated and described, it will be appreciated that various changes can be made therein without departing from the spirit and scope of the invention. Some of such changes have been suggested, such as varying the orientation of slave rod 80 relative to push rod 40.

The embodiments of the invention in which an exclusive property or privilege is claimed are defined as follows:

1. A brake for an in-line skate having a base, a cuff movably secured to the base, and wheels secured to the base for rolling on a riding surface, the brake comprising:

a) a tab secured to the cuff;

b) a slide housing attached to the base and including a master cylinder within an upper portion thereof and a slave cylinder within a lower portion thereof;

c) an upper elongate member slidably secured at least partially within said slide housing, said upper elongate member having a lower portion extending within said master cylinder and defining an upper end positioned adjacent said tab so as to contact said tab when said cuff is moved rearwardly with respect to said base, and a lower elongate member having an upper portion extending within said slave cylinder and a lower end projecting therefrom, d) a fluid disposed between said upper and lower portions of said elongate members and contained at least partially within said master and slave cylinders, downward movement of said upper elongate member caused by rearward movement of said cuff creating fluid pressure to force said fluid to flow from said master cylinder to said slave cylinder and said lower elongate member to move in a downward direction; and e) a brake element secured to the lower end of said elongate member, said brake element being positioned in proximity to at least one of the wheels and riding surface for selective frictional engagement with the riding surface upon rearward movement of said cuff.

2. The brake of claim 1, wherein said master cylinder is disposed behind a rear portion of said skate and wherein said base includes a frame, said slave cylinder being attached within said frame, a fluid conduit connecting said master cylinder and said slave cylinder.

3. The brake of claim 1, wherein the diameter of said master cylinder is greater than the diameter of said slave cylinder.

4. The brake of claim 1, wherein said master cylinder and slave cylinder are generally aligned, said slave cylinder being disposed beneath said master cylinder.

5. The brake of claim 1, wherein said upper and lower elongate members comprise first and second rods, respectively.

6. The brake of claim 1, wherein said brake element comprises a pad for engagement with the riding surface.

7. The brake of claim 6, wherein said brake element further comprises a pad support bracket with a support extension slidably held by said slide housing, said pad being secured to said support bracket.

8. The brake of claim 1 further comprising a biasing member disposed within said housing for biasing said lower elongate member upwardly toward said tab.

9. A brake for an in-line skate having a base, a cuff movably secured to the base, and wheels secured to the base for rolling on a riding space, the brake comprising:

a) a master cylinder holding fluid, said master cylinder being secured to a rear portion of said skate, said master cylinder having a master piston slidably disposed therein, said master piston being operatively coupled to said cuff and movable in response to movement of said cuff;

b) a slave cylinder secured to said skate and hydraulically coupled to said master cylinder, said slave cylinder holding fluid, and having a slave piston slidably disposed therein;

c) an interconnection between said master cylinder and said slave cylinder such that fluid may flow between said master cylinder and said slave cylinder said slave piston being movable due to fluid pressure in response to movement of said master piston; and d) a ground engageable brake element secured to said slave piston and disposed in proximity to the riding surface for movement toward and away from the riding surface upon movement of the slave piston.

* * * * *

UNITED STATES PATENT AND TRADEMARK OFFICE

CERTIFICATE OF CORRECTION

PATENT NO. : 5,865,445

DATED : February 2, 1999

INVENTOR(S) : J.E. Svensson et al.

It is certified that error appears in the above-indentified patent and that said Letters Patent is hereby corrected as shown below:

| COLUMN | LINE | |
|---|---|---|
| 11 (Claim 9, | 8 line 3) | "space" should read --surface-- |

Signed and Sealed this

Sixth Day of July, 1999

*Attest:*

Q. TODD DICKINSON

*Attesting Officer*

*Acting Commissioner of Patents and Trademarks*